United States Patent [19]

Stahlecker

[11] Patent Number: 4,896,976

[45] Date of Patent: Jan. 30, 1990

[54] SUPPORTING DISK FOR A SUPPORTING DISK BEARING

[75] Inventor: Fritz Stahlecker, Bad Überkingen, Fed. Rep. of Germany

[73] Assignee: Hans Stachlecker, Fed. Rep. of Germany

[21] Appl. No.: 200,855

[22] Filed: Jun. 1, 1988

[30] Foreign Application Priority Data

Jun. 11, 1987 [DE] Fed. Rep. of Germany ..... 3719445

[51] Int. Cl.[4] ..... F16C 19/50

[52] U.S. Cl. ..... 384/549; 384/565; 57/103

[58] Field of Search ..... 57/103, 104, 105, 404, 57/406, 92; 384/549, 550, 548, 569, 277, 278, 279, 418, 900, 565

[56] References Cited

U.S. PATENT DOCUMENTS

| | | | |
|---|---|---|---|
| 4,667,464 | 5/1987 | Stahlecker et al. | 57/92 X |
| 4,676,673 | 6/1987 | Stahlecker et al. | 57/103 X |
| 4,713,932 | 12/1987 | Zott | 57/406 |

FOREIGN PATENT DOCUMENTS

| | | | |
|---|---|---|---|
| 2206264 | 8/1973 | Fed. Rep. of Germany | 57/103 |
| 3447600A1 | 6/1986 | Fed. Rep. of Germany . | |
| 3615777A1 | 11/1987 | Fed. Rep. of Germany . | |

*Primary Examiner*—Lenard A. Footland

*Attorney, Agent, or Firm*—Barnes & Thornburg

[57] ABSTRACT

A supporting disk apparatus for engagement with an open-end spinning rotor shaft is provided. Supporting disk elements are provided for engaging the rotor shaft. The supporting disk elements include an outer circumference area providing a running surface for the rotor shaft. The outer circumference area is constructed such that this area is elastically deformed by the rotor shaft. Ring groove elements are provided around and extend into the supporting disk elements outer circumference area. The ring groove elements have a depth in a radial direction of the supporting disk elements slightly larger than the elastic deformation of the outer circumference area in the radial direction of the supporting disk elements which is caused by the rotor shaft. This supporting disk apparatus provides a reduction of heat build-up of the running surface of the supporting disk elements.

8 Claims, 2 Drawing Sheets

SUPPORTING DISK FOR A SUPPORTING DISK BEARING

BACKGROUND AND SUMMARY OF THE INVENTION

The invention relates to a supporting disk for a supporting disk bearing for a shaft of an open-end spinning rotor.

Supporting disk bearings are used very successfully and in large numbers in open-end rotor spinning machines. The continuing rise of the rotational speeds results in problems, such as increased wear at rings of the supporting disks that are made of plastic. Such disks include a metal base body which is surrounded by a plastic ring. It was found that the rings heat up in a center area and thus a heat build-up occurs in this area, particularly at high rotational speeds. At times, bubbles form directly under the surface of the rings. In some cases, these bubbles later opened up, and plastic material has broken out at various points. These crater-type holes resulted in the spinning rotor no longer running smoothly, so that the rotor shaft delivered hard blows to the running surface. This accelerated the damaging of the plastic rings. It is assumed that the heating-up in the rings made of plastic results because the rotor shaft causes only a slight deformation at the plastic rings which is connected with a flexing process.

In German Published Unexamined Patent 3,447,600, a surrounding ring groove is provided in the center of the running surfaces which improves the dissipation of heat in the central area. In this patent, the depth of the ring groove is selected such that it corresponds to approximately half the thickness of the plastic ring in radial direction. This arrangement merely increases air flow through the ring groove to dissipate heat, and does not address reducing the stress in the central running surfaces of the disk.

It has also been suggested in Patent Application P 36 15 777.5, which is not a prior publication and thus is not prior art, to provide the plastic rings with an uninterrupted cylindrical running surface, and to achieve a reduction of the heating-up process by providing a profiling of the base body which engages in the inner surface of the ring. The profiling reduces the thickness of the central area of the rings in comparison to the edge areas on either side of the central area. By reducing the thickness of the central area, the build-up of heat is reduced in this area, while, at the same time, the heat dissipation via the base body is improved.

An object of the present invention is to provide a further improvement of a supporting disk assembly of the initially mentioned type in view of possible heating-up and the resulting wear phenomenon.

This object and other objects are achieved by providing an outer circumferential area of a supporting disk with a ring groove having a depth in radial direction slightly larger than the elastic deformation of the running surface in radial direction caused by the rotor shaft.

In the present invention, the shaft just barely does not come in contact with the outer surface of the supporting disk in the area of the ring groove. Because of the shallow depth, the ring groove is very flat. The very flat ring groove is not created to merely improve the cooling air flow through the ring groove, and thus to improve the dissipation of heat that is shown in known arrangements. The very flat ring groove according to the present invention provides a reduction of stress in the supporting disk, caused by the shaft of the spinning rotor such that the stress is removed from the running surfaces in the central area. Therefore, the rotor shaft does not subject the supporting disk to any flexing process in the central area.

According to advantageous features of certain preferred embodiments of the invention, the outer circumferential area of the supporting disk includes a ring made of plastic. The very low depth of the ring groove also has the advantage that the plastic ring is practically not weakened in axial direction. In this case, it should be noted that via the plastic rings of the supporting disks, an axial force is exercised on the shaft of the spinning rotor against which the shaft is supported at the step bearing. A deep ring groove may have the effect that the ring is weakened as the result of a type of "notch effect".

In other advantageous features of certain preferred embodiments of the invention, a profiling (or flange) is provided between the circumference of the base body and the inner surface of the ring. This results not only in a good connection between the base body and the ring, but because the contact surfaces are enlarged, the dissipation of heat via the metallic base body is also improved. In certain embodiments, it is provided in this case that the profiling is constructed as a ring groove and a rib and is arranged essentially symmetrically with respect to the radial center plane of the ring. As a result, it is achieved that the ring in the center has only a relatively low accumulation of material so that the danger of a build-up of heat in the central area is reduced further.

Other objects, advantages and novel features of the present invention will become apparent from the following detailed description of the invention when considered in conjunction with the accompanying drawings.

DETAILED DESCRIPTION OF THE DRAWINGS

Figure 1:
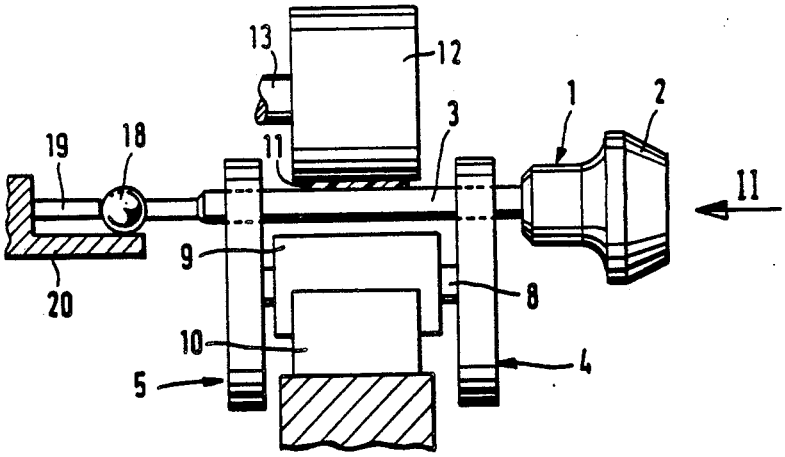
FIG. 1 is a partial cross-sectional view of a supporting disk bearing for a shaft of an open-end spinning rotor according to certain preferred embodiments of the present invention.
Figure 2:
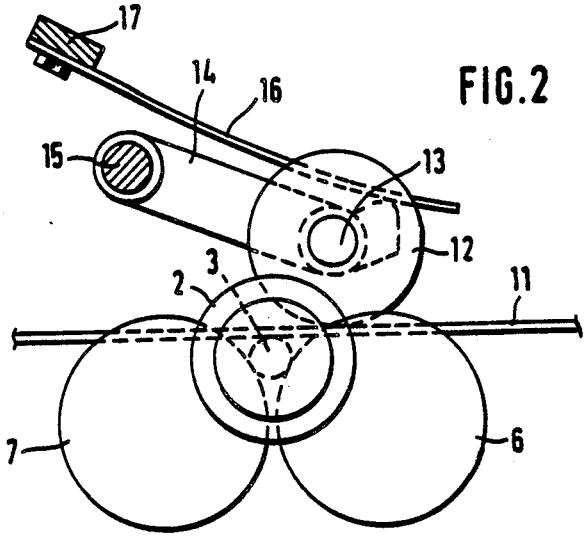
FIG. 2 is a view in the direction of Arrow II of the supporting disk bearing according to FIG. 1, in which some parts are omitted and others parts are added in comparison to FIG. 1.

According to FIGS. 1 and 2, the open-end spinning rotor 1 disposed in the supporting disk bearing has a rotor 2 and a rotor shaft 3. The rotor shaft 3, in radial direction, is disposed in the wedge-shaped gaps of two pairs 4, 5 of supporting disks. Each pair 4, 5 of supporting disks includes two supporting disks 6, 7, having shafts 8 which are inclined with respect to one another at a slightly offset angle, so that the supporting disks 6, 7 exercise an axial force on the rotor shaft 3. The shafts 8 of the supporting disks 6, 7 are disposed in bearings, the bearing housings 9 of which are held in a bearing block 10.

For the driving of the rotor shaft 3, a tangential belt 11 is used which passes through in longitudinal direction of a machine that has a plurality of bearings of this type. The tangential belt 11 drives all spinning rotors 1 of one side of the machine. The tangential belt 11 is pressed in the direction of the rotor shaft 3 by a pressure roller 12. In certain preferred embodiments, the pressing force of the pressure roller 12 amounts to approximately 25N. The pressure roller 12 is disposed on a swivel arm 14 on a shaft 13 that is parallel to the rotor shaft 3. In turn, the swivel arm 14 is pivotable around a stationary shaft 15 that is parallel to the shaft 13. The swivel arm 14 is loaded by a leaf spring 16 that generates the pressing force and that is mounted at a stationary holding part 17.

In axial direction, the rotor shaft 3 is supported with respect to the axial force caused by the supporting disks 6, 7 against a step bearing ball 18. A pin 19 supports the step bearing ball 18 on the side that is opposite the rotor shaft 3. The pin 19 is disposed in a holding device 20 such that the step bearing ball 18 can move as a result of vibrations.

Figure 3:
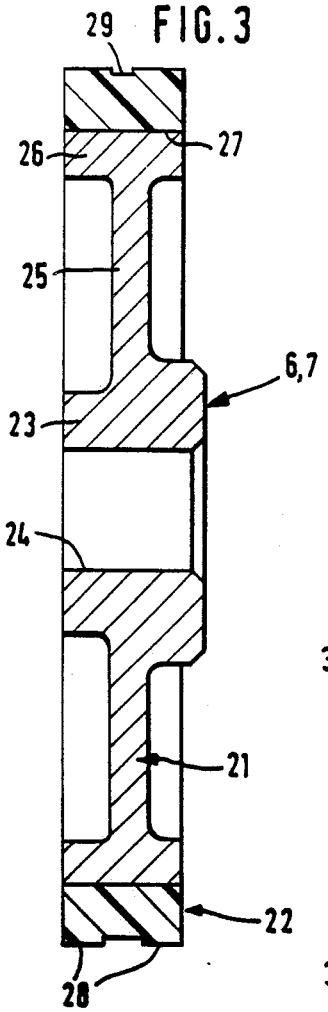
FIG. 3 is an enlarged axial cross-sectional view of a supporting disk according to certain preferred embodiments of the invention.

According to FIG. 3, the supporting disks 6, 7 have a base body 21 made of metal, particularly of aluminum or an aluminum alloy. This base body 21 has a hub 23 that is provided with a central axial bore 24 for the shaft 8. Via a web 25, the hub 23, is connected with a rim 26. On the outer circumference 27, of the rim, a ring 22 made of plastic is disposed. The outer surface 28 of the ring 22 is subdivided by a flat ring groove 29. In certain preferred embodiments, the depth of the ring groove 29 should amount to a maximum of 0.3 mm. The width of the centrally arranged ring groove 29 amounts to approximately five times the depth. The ring 22 is vulcanized or cast onto the circumference 27 of the base body 21. The flat ring groove 29 may be applied by cutting or, if necessary, may also be applied during casting or vulcanizing. In the latter case, the bottom of the ring groove 29 has a rougher surface than the ground running surface 28 of the ring 22. However, this has no disturbing effect because the rotor shaft 3 does not move against the rougher surface.

Figure 4:
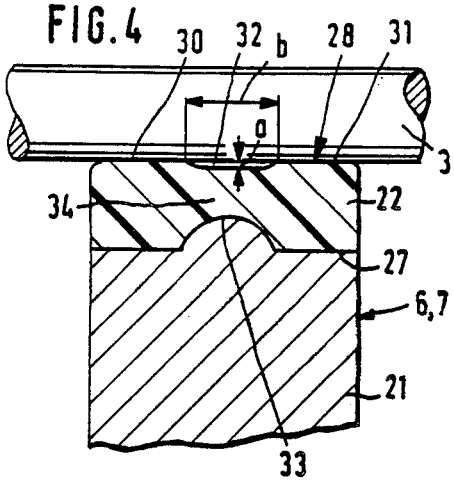
FIG. 4 is a further enlarged view of certain detail of a supporting disk according to certain preferred embodiments of the present invention, with the shaft of a spinning rotor running against it.

The dimension of the ring groove 32 is shown more clearly in the embodiments according to FIG. 4 in which the running area of a supporting disk 6, 7, together with a part of the rotor shaft 3, is shown at a considerably enlarged scale. The ring groove 32 provided in the ring 22 ends in a rounded area in the direction of the lateral partial running surfaces 30, 31 of the running surface 28. The depth (a) of the ring groove 32 is such that the rotor shaft 3 is free of the shaft 3 in the area of the ring groove 32, so that it cannot have a flexing effect there. To assure that the ring 22 is free of the shaft 3 in the area of the ring groove 32, the depth (a) of the ring groove 32 (as well as the depth of the ring grooves of the other embodiments) is dimensioned to be such that the elastic deformation of the running surface 28 in radial direction, caused by the rotor shaft 3, is slightly less than the depth (a).

The plastic of the ring 22 has a hardness of approximately 52 Shore D. The diameter of the shaft 3 is between 7 and 10 mm. In practice, the deformation that occurs as a result of the given forces is usually less than 0.1 to 0.2 mm so that a depth (a) of 0.1 to 0.2 mm is sufficient. Taking into account a safety increase and, if necessary, possible wear, a depth (a) of 0.3 mm is sufficient in order to prevent a flexing process from occurring in the area of the ring groove 32. The heating-up of the ring 22 will remain the highest in the central area. However, since the shaft 3 does not run against the ring in the central area and causes no flexing, it is achieved that, despite the heating-up, no damage is caused to the ring 22 in this area.

In order to improve the heat dissipation in the particularly endangered central area, an approximately semicircular surrounding rib 33 is provided at the outer circumference 27 of the base body 21, as shown in the embodiment according to FIG. 4. By means of the rib 33, the thickness of the central area 34 of the ring 22 is reduced and approximately cut in half. As a result, although the damping effect of the ring 22 is reduced in this area, it not damaging because the shaft 3 is not supported in this area.

Figure 5:
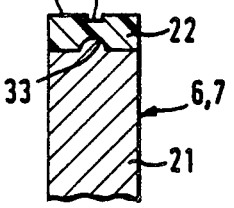
FIGS. 5 to 10 are partial cross-sectional views of other preferred embodiments of supporting disks.

In the embodiments according to FIG. 5, a ring groove 29 is provided corresponding to the embodiment according to DFIG. 3. The outer circumference of the base body 21 is provided with a surrounding rib 33. In this embodiment, the ring groove 29 is created by cutting, particularly by means of grooving with a turning tool.

Figure 6:
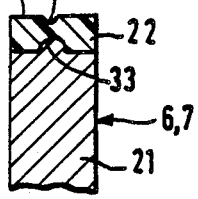

The embodiments according to FIG. 6, in basic construction, correspond to the embodiments according to FIG. 5. However, the surrounding ring groove 35 of the ring 22 is constructed to be very narrow (narrower than the embodiments of FIG. 5). Under certain circumstances, it may be sufficient for the ring groove 35 to have a width of 1 mm or less. This also has the effect that the particularly endangered central zone is relieved. This is sufficient because break-outs from the material almost always occur precisely in the center of the running surface 28.

The embodiments according to FIGS. 7 to 10 all have a ring groove 29, 32 or 35 corresponding to the preceding embodiments. They differ, however, with respect to the anchoring between the base body 21 and the ring 22.

Figure 7:
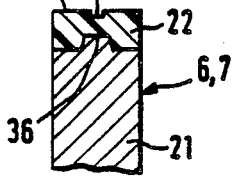

In the embodiment according to FIG. 7, the rib 36 is made relatively sharp-edged, which results in a particularly good anchoring. This type of shaping is particularly useful when the bae body 21 is produced as an extruded part which is usually the case.

Figure 8:
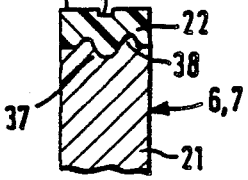

In the embodiments according to FIG. 8, it is provided that the rest of the outer circumference of the base body 21 is provided with two parallel ribs 38 that project over the circumference of the base body. Between these two ribs 38, a ring groove 37 is provided that is deepened in comparison to the rest of the outer circumference of the base body. In this embodiment, the thickness of the ring 22 is therefore reduced in an area laterally adjacent to the ring groove 37 on each side of the ring groove, and is thicker in the area of the ring groove 29.

Figure 9:
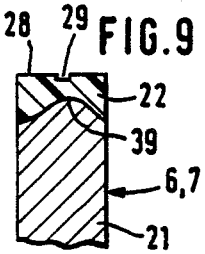

In the embodiments according to FIG. 9, it is provided that the wole outer circumference of the base body 21 is rounded asymmetrically with respect to the center, so that a type of sinusoidal curve 39 is created. The summit of the curve 39 is slightly laterally offset with respect to the ring groove 29.

Figure 10:
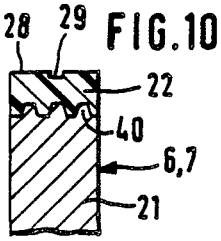

In the embodiments according to FIG. 10, it is provided that the outer circumference is provided with several ribs 40. In certain preferred embodiments, the several ribs 40 are subdivided in circumferential direction, so that tooth-type projections are created.

All embodiments according to FIGS. 4 to 10 achieve an enlargement of the surface at which the outer circumference of the base body 21 and the ring 22 come in contact, so that the dissipation of heat is improved.

As a kinematic reversal of the shown embodiments, it is contemplated to provide the area of the rotor shaft 3 which runs against the rings 22 with a (flat) ring groove. In this manner the central area of the ring 22 is also relieved from flexing.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. Supporting disk apparatus for engagement with an open-end spinning rotor shaft such that the rotor shaft creates an elastic deformation of said supporting disk apparatus, said apparatus comprising:

supporting disk means for engaging the rotor shaft, said supporting disk means including an outer circumference area providing a running surface for the rotor shaft, said outer circumference area being constructed such that said outer circumference area is elastically deformed a given distance by the rotor shaft and;

ring groove means provided around and extending into said supporting disk means outer circumference area, said ring groove means having a depth in a radial direction of said supporting disk means slightly larger than the given distance of elastic expected deformation of said outer circumference area in the radial direction of said supporting disk means caused by the rotor shaft during operation, wherein said ring groove means exhibits a width dimension in an axial direction of said supporting disk means which is substantially greater than the radial depth of said ring groove means.

2. Apparatus as in claim 1, wherein said ring groove means depth is no greater than 0.3 mm.

3. Apparatus as in claim 1, wherein said ring groove means exhibits a width dimension in the axial direction of said supporting disk means which is about five times greater than said radial depth.

4. Apparatus as in claim 1, wherein said supporting disk means includes:

a base body;

a ring member disposed around said base body, said ring member including an inner surface adjacent said base body and an outer surface including said outer circumference area and said ring groove means; and a profiling member disposed between said base body and said inner surface of said ring member.

5. Apparatus as in claim 4, wherein said profiling member includes at least one rib projecting out from said base body toward said ring member.

6. Apparatus as in claim 5, wherein said ring groove means and said rib are arranged essentially symmetrically with respect to a radial center plane of said ring member.

7. Apparatus as in claim 1, wherein said supporting disk means includes:

a base body made of metal material; and a ring member made of elastically deformable material disposed around said base body, said ring member having an outer surface including said outer circumference area and said ring groove means.

8. Apparatus as in claim 7, wherein said ring member is made of plastic material.

* * * * *